US008427254B2

(12) United States Patent
Shinohara et al.

(10) Patent No.: US 8,427,254 B2
(45) Date of Patent: Apr. 23, 2013

(54) FERRITE PHASE SHIFTER AND AUTOMATIC MATCHING APPARATUS

(75) Inventors: Kibatsu Shinohara, Yokohama (JP); Shigetsugu Tsuruoka, Yokohama (JP)

(73) Assignee: Nihon Koshuha Co., Ltd., Kanagawa (JP)

( * ) Notice: Subject to any disclaimer, the term of this patent is extended or adjusted under 35 U.S.C. 154(b) by 748 days.

(21) Appl. No.: 12/285,847

(22) Filed: Oct. 15, 2008

(65) Prior Publication Data

US 2009/0128257 A1 May 21, 2009

(30) Foreign Application Priority Data

Nov. 19, 2007 (JP) ..... 2007-298876

(51) Int. Cl.
*H01P 5/02* (2006.01)
*H01P 1/18* (2006.01)

(52) U.S. Cl.
USPC ..... 333/17.3; 333/33; 333/158

(58) Field of Classification Search ..... 333/17.1, 333/17.3, 32–35, 24.1, 158
See application file for complete search history.

(56) References Cited

U.S. PATENT DOCUMENTS 3,273,082 A * 9/1966 Chiron ..... 333/158
3,617,953 A * 11/1971 Kingma et al. ..... 333/17.1
3,698,008 A * 10/1972 Roberts et al. ..... 333/158
4,434,426 A * 2/1984 Gaglione et al. ..... 342/372
4,682,126 A 7/1987 Milberger et al.
5,041,803 A * 8/1991 Shinohara et al. ..... 333/17.3
5,065,118 A * 11/1991 Collins et al. ..... 333/33

FOREIGN PATENT DOCUMENTS

| | | |
|---|---|---|
| JP | 54-047555 | 4/1979 |
| JP | 57-053102 | 3/1982 |
| JP | 04-243303 | 8/1992 |
| JP | 07-307602 | 11/1995 |
| JP | 10-075107 | 3/1998 |

OTHER PUBLICATIONS

Tadashi Hashimoto, "Microwave Ferrite and Applications," Sogo Denshi Shuppan-sha, May 10, 1997, pp. 111-114 with machine translation.
Office Action dated Jan. 11, 2008, issued on the corresponding Japanese Application No. 2007-298876 and the partial English translation thereof.

* cited by examiner

*Primary Examiner* — Benny Lee
*Assistant Examiner* — Gerald Stevens
(74) *Attorney, Agent, or Firm* — Edwards Wildman Palmer LLP; James E. Armstrong, IV; George N. Chaclas

(57) ABSTRACT

In a ferrite phase shifter, a temperature rise at ferrites can be suppressed to maintain the characteristics of the frites even when used at high power. Thus, the phase shifter can stably demonstrate high performance. The ferrite phase shifter includes a rectangular waveguide, substantially sheet-like ferrites disposed to face each other with respective mounting surfaces kept in tight contact with inner walls of wide surfaces of the rectangular waveguide facing each other, and a coil which is wound around the periphery of the rectangular waveguide in a position substantially corresponding to the position of the ferrites and through which a current is passed.

8 Claims, 12 Drawing Sheets

Fig. 18 -- Prior Art --
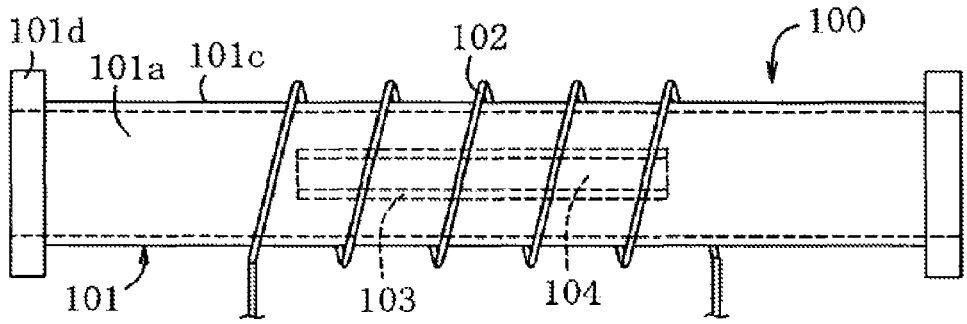
Fig. 19 -- Prior Art --
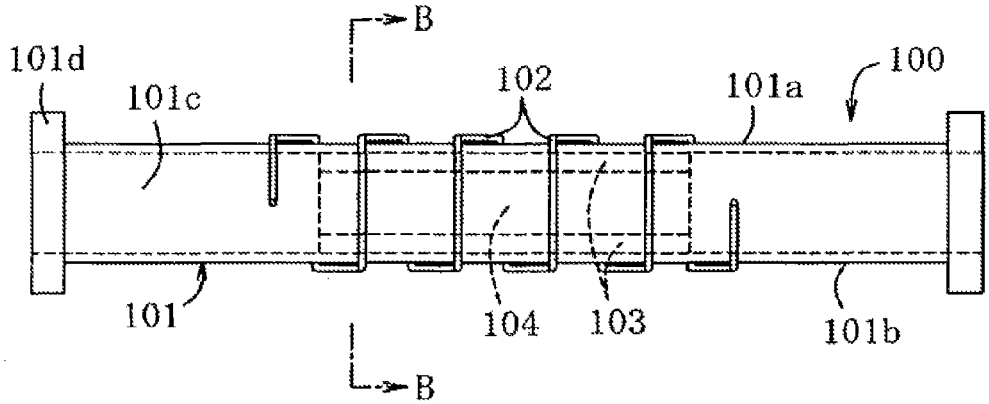

Fig. 20 -- Prior Art --
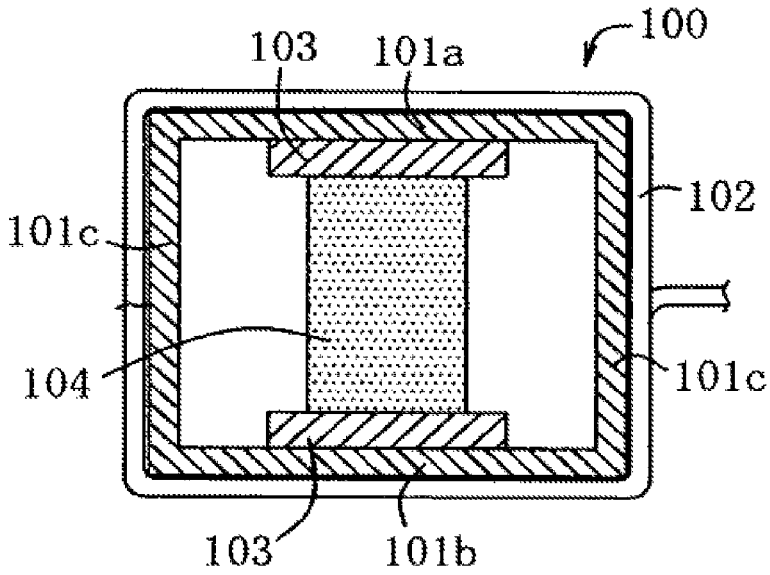

FERRITE PHASE SHIFTER AND AUTOMATIC MATCHING APPARATUS

BACKGROUND OF THE INVENTION

1. Field of the Invention

The present invention relates to a ferrite phase shifter which generates a magnetic field by passing a current through a coil from outside of a rectangular waveguide to change magnetic characteristics of a ferrite and to change a waveguide wavelength of a high frequency wave propagating in the waveguide, thereby changing the phase of the high frequency wave. The invention also relates to an automatic matching apparatus having such a ferrite phase shifter.

2. Description of the Related Art

Ferrite phase shifters are known, in which a ferrite is disposed in a waveguide to generate a magnetic field for changing the phase of a high frequency wave propagating in the waveguide. For example, such a ferrite phase shifter is configured as shown in FIGS. 18 to 20. A ferrite phase shifter 100 shown in FIGS. 18 to 20 includes a substantially square cylindrical rectangular waveguide 101 formed by a top face 101*a*, a bottom face 101*b* and two side faces 101*c*, and blade-like flanges 101*d* to serve as coupling sections for coupling with other rectangular waveguides are formed on both longitudinal ends of the waveguide. A coil 102 is substantially helically wound around the rectangular waveguide 101 substantially in the middle thereof. A sheet-like spacer 103 made of a dielectric material is provided at each of upper and lower positions in the rectangular waveguide 101, and the spacers 103 are disposed to extend in the longitudinal direction of the rectangular waveguide 101. The upper and lower spacers 103 are secured so as to sandwich a rectangular parallelepiped ferrite 104 between them.

The ferrite phase shifter is used as follows. For example, the rectangular waveguide 101 is coupled with other rectangular waveguides to form a waveguide path, and a high frequency wave is propagated in the rectangular waveguide 101 through the waveguide path. A current is passed through the coil 102 from the outside of the rectangular waveguide 101 to generate a magnetic field. Thus, magnetic characteristics of the ferrite are changed to change a waveguide wavelength of the high frequency wave, whereby the phase of the propagating high frequency wave is changed (see Non-Patent Document 1).

Non-Patent Document 1: Tadashi Hashimoto, Microwave Ferrite and Applications, issued by Sogo Denshi Shuppansha on May 10, 1997, pp. 111-114

SUMMARY OF THE INVENTION

When a voltage input to a ferrite phase shifter becomes too high, heat is generated because of increased loss at the ferrite. In the case of the above-described ferrite phase shifter 100, since the ferrite 104 is secured through the spacers 103, heat generated as thus described is not released smoothly, and the temperature of the ferrite increases. Such a temperature rise of the ferrite results in significant changes in characteristics of the ferrite, and the function of the phase shifter can be consequently degraded.

The invention is proposed to confront the above-described problem, and the invention provides a ferrite phase shifter which can stably demonstrate high performance as a phase shifter because a temperature rise at the ferrite can be suppressed to maintain characteristics of the ferrite even when used at a high power. The invention also provides an automatic matching apparatus having such a ferrite phase shifter.

(1) A ferrite phase shifter according to the invention is characterized in that it includes a rectangular waveguide, substantially sheet-like ferrites disposed to face each other with respective mounting surfaces thereof kept in tight contact with inner walls of wide surfaces of the rectangular waveguide facing each other, and a coil which is wound around the periphery of the rectangular wave guide in a position substantially corresponding to the position of the ferrite and through which a current is passed.

(2) The invention provides a ferrite phase shifter according to (1), characterized in that the substantially sheet-like ferrites are formed by arranging a plurality of ferrite pieces with predetermined gaps left between them.

(3) The invention provides a ferrite phase shifter according to (1) or (2), characterized in that it includes dielectric layers provided on surfaces of the substantially sheet-like ferrites facing each other.

(4) The invention provides a ferrite phase shifter according to any of (1) to (3), characterized in that it includes yokes provided in positions substantially corresponding to the positions of the substantially sheet-like ferrites on outer walls of the wide surfaces of the rectangular waveguide.

(5) The invention provides a ferrite phase shifter according to any of (1) to (3), characterized in that it includes at least one pair of holes having a structure to serve as a cut-off for a propagating high frequency wave, the holes being provided at both ends of the substantially sheet-like ferrites in the longitudinal direction of the rectangular waveguide and a ferrite different from the substantially sheet-like ferrites provided in each of the holes. The ferrite phase shifter is also characterized in that inner ends of the other ferrites are connected to the substantially sheet-like ferrites and in that outer ends of the other ferrites are connected to each other through the yokes. For example, the holes to serve as a cut-off structure are provided with an inner diameter and a depth which are set such that a high frequency wave cut-off frequency determined by the inner diameter and the depth of the holes will be higher than the frequency band of a high frequency wave propagating in the rectangular waveguide.

(6) The invention provides a ferrite phase shifter according to (4) or (5), characterized in that it includes a permanent magnet provided in part of the yokes.

(7) The invention provides a ferrite phase shifter according to any of (1) to (6), characterized in that it includes at least one elongate square cylindrical section provided on each of the wide surfaces of the rectangular waveguide so as to protrude outwardly, the elongate square cylindrical section having a slit whose longitudinal direction agrees with the longitudinal direction of the rectangular waveguide.

(8) The invention provides a ferrite phase shifter according to (7), characterized in that the elongate square cylindrical sections having a slit are arranged side by side on each of the wide surfaces of the rectangular waveguide.

(9) The invention provides a ferrite phase shifter according to (7) or (8), characterized in that it includes an insulation layer provided outside the slit when viewed in the longitudinal direction of the slit.

(10) The invention provides a ferrite phase shifter according to any of (7) to (9), characterized in that it includes a dielectric body provided in the slit.

(11) The invention provides an automatic matching apparatus characterized in that it includes a matching device employing at least one ferrite phase shifter as a matching element, provided on a transmission path between a power supply and a load.

In addition to the configurations described above and configurations of embodiments of the invention, the scope of the invention disclosed in this specification includes partial substitutions between the inventive configurations, combinations of the inventive configurations, and configurations representing superordinate concepts of the invention obtained by deleting parts of the inventive configurations within a limit in which partial effects of the invention can be achieved.

In a ferrite phase shifter and an automatic matching apparatus according to the invention, ferrites have a substantially sheet-like shape which suppresses accumulation of heat. The substantially sheet-like ferrites are disposed in tight contact with inner walls of wide surfaces of a rectangular waveguide to reduce resistance to radiation. Thus, heat generated at the ferrites can be smoothly released through the walls of the rectangular waveguide, and a high cooling effect can be achieved. Therefore, a temperature rise at the ferrites can be suppressed to maintain the characteristics of the ferrites even when they are used at a high power, and the phase shifter can stably demonstrate high performance.

When the substantially sheet-like ferrites are formed by arranging a plurality of ferrite pieces with some gaps left between them, the generation of a great thermal stress at the substantially sheet-like ferrites can be prevented by a difference between the expansion coefficients of the rectangular waveguide and the ferrites. Thus, the ferrites can be prevented from cracking.

When dielectric layers are provided on the surfaces of the substantially sheet-like ferrites facing each other, an electromagnetic field distribution generated in the rectangular waveguide can be concentrated at the ferrites to increase the electromagnetic field intensity of a high frequency wave in the region of the ferrites. Thus, the rate of a phase change caused by the ferrites can be improved.

When yokes are provided in positions substantially corresponding to the position of the substantially sheet-like ferrites on the outer walls of the wide surfaces of the rectangular waveguide, magnetic circuits are formed by the ferrites and the yokes. The magnetic circuits allow the amount of a current flowing through the coil to be reduced or allow the number of turns of the coil to be reduced.

At least one pair of holes having a structure to serve as a cut-off for a propagating high frequency wave is provided at both ends of the substantially sheet-like ferrites in the longitudinal direction of the rectangular waveguide. A ferrite different from the substantially sheet-like ferrites is provided in each of the holes. Inner ends of the other ferrites are connected to the substantially sheet-like ferrites, and outer ends of the other ferrites are connected to each other through the yokes. Thus, magnetic circuits are formed by the substantially sheet-like ferrites, the other ferrites and yokes. It is therefore possible to reduce the amount of a current flowing through the coil or the number of turns of the coil. It is also possible to improve response of a variable magnetic field to the rate of a time-varying change in a control current passed through the coil.

When permanent magnets are provided in some part of the yokes, a magnetic bias can be applied to reduce the amount of a phase change and to achieve a further improvement in response.

At least one elongate square cylindrical section is provided on each of the wide surfaces of the rectangular waveguide so as to protrude outwardly, and the elongate square cylindrical section has a slit whose longitudinal direction agrees with the longitudinal direction of the rectangular waveguide. Thus, an electrical resistance to a variable magnetic field can be increased to suppress an eddy current generated by a variable magnetic field on the outer walls of the wide surfaces.

When the elongate square cylindrical sections having a slit are arranged side by side on each of the wide surfaces of the rectangular waveguide, an electrical resistance to a variable magnetic field can be further increased to achieve a further improvement in the effect of suppressing an eddy current generated on the outer walls of the wide surfaces by the variable magnetic field.

When the insulation layers is provided outside the slit in the longitudinal direction of the slit, it is possible to achieve a further improvement in the effect of suppressing an eddy current provided by the elongate square cylindrical sections having a slit.

When the dielectric body is provided in the slit, the slit can be provided with capacitive properties, which makes it possible to reduce impedance against a high frequency wave and to thereby prevent leakage of the high frequency wave.

The automatic matching apparatus according to the invention can be electrically (electronically) driven, whereas automatic matching apparatus according to the related art are mechanically driven. Therefore, a higher matching speed can be achieved to shorten matching time. Specifically, a matching time in the range from 10 to 20 msec can be achieved, whereas matching has taken 1 to 2 sec according to the related art. Further, since the apparatus scarcely fails, it can be used on a maintenance free basis.

BRIEF DESCRIPTION OF THE DRAWINGS

FIG. 18 is a plan view of a ferrite phase shifter according to the related art;

FIG. 19 is a side view of the ferrite phase shifter according to the related art; and FIG. 20 is a sectional view of the ferrite phase shifter in FIG. 19 taken along the line B-B.

DESCRIPTION OF THE PREFERRED EMBODIMENTS

Ferrite phase shifters and automatic matching apparatus having the ferrite phase shifters according to embodiments of the invention will now be described.

Ferrite Phase Shifter of First Embodiment

Figure 1:
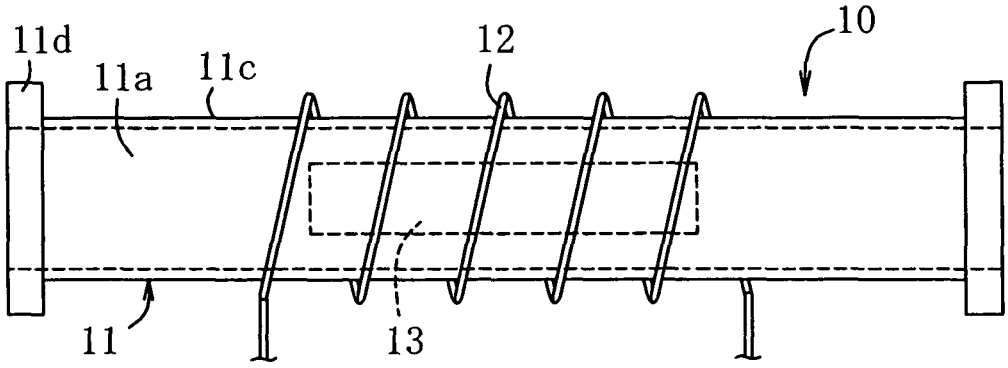
FIG. 1 is a plan view of a ferrite phase shifter according to a first embodiment of the invention.
Figure 2:
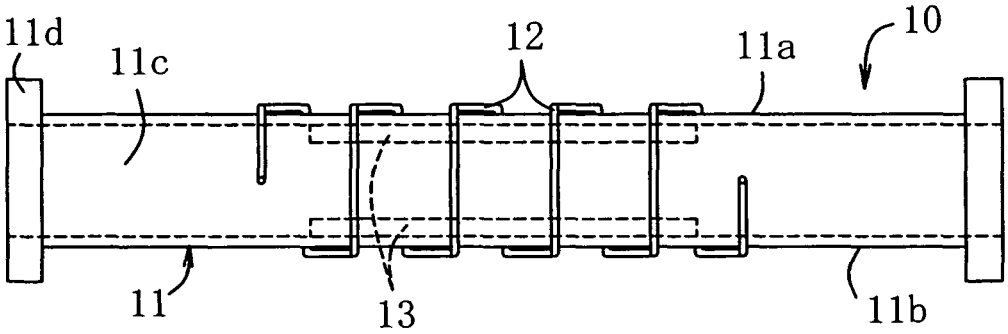
FIG. 2 is a side view of the ferrite phase shifter according to the first embodiment of the invention.

As shown in FIGS. 1 and 2, a ferrite phase shifter 10 according to a first embodiment of the invention includes a substantially square cylindrical rectangular waveguide 11 formed by a top face 11*a*, a bottom face 11*b* and two side faces 11*c*, and blade-like flanges 11*d* to serve as coupling sections for coupling with other rectangular waveguides are formed on both longitudinal ends of the waveguide. A coil 12 through which a current is passed is substantially helically wound around the periphery of the rectangular waveguide 11 substantially in the middle thereof. The coil 12 is wound such that it diagonally extends outside the top face 11*a* and the bottom face 11*b* and such that it substantially vertically extends on the side faces 11*c*. The coil 12 is wound in a position substantially corresponding to the position of ferrites 13 which will be described later.

A rectangular ferrite 13 in the form of an elongate sheet is provided on each of inner walls of the top face 11*a* and the bottom face 11*b* which are wide faces of the rectangular waveguide 11 opposite to each other. Wide surfaces on one side of the ferrites 13 constitute mounting surfaces, and the ferrites are disposed with the mounting surfaces kept in tight contact with the respective inner walls of the top face 11*a* and the bottom face 11*b* such that the longitudinal direction of the ferrites agrees with the longitudinal direction of the rectangular waveguide 11 constituting the propagating direction of a high frequency wave. The ferrite 13 on the side of the top face 11*a* and the ferrite 13 on the side of the bottom face 11*b* are disposed on the inner walls in a face-to-face relationship with the walls, and wide surfaces on the other side of the ferrites 13 (wide surfaces on the side opposite to the side where the mounting surfaces are provided) face each other.

The material of the ferrites 13 may be appropriately selected from a certain range of usable materials and, for example, a garnet type ferrite material is preferably used. The configuration employed to secure the ferrites 13 in the rectangular waveguide 11 may be also appropriately selected from a range of usable configurations. For example, the ferrites may be secured using an adhesive having high radiating properties or screwed.

To form a waveguide path using the ferrite phase shifter 10 of the first embodiment, other rectangular waveguides are disposed upstream and downstream of the rectangular waveguide 11, and the waveguide 11 is coupled with the other rectangular waveguides through the flanges 11*d* on both ends thereof. The waveguide path is used as follows. For example, a high frequency wave is propagated in the rectangular waveguide 11 through the waveguide path, and magnetic characteristics of the ferrites are changed by passing a current through the coil 12 wound around the periphery of the rectangular waveguide 11 to generate a magnetic field or by changing the current flowing through the coil 12 to change the magnetic field. Thus, a waveguide wavelength of the high frequency wave is changed, which results in a change in the phase of the propagating high frequency wave.

In the ferrite phase shifter 10 of the first embodiment, accumulation of heat at the ferrites 13 is suppressed because the ferrites 13 have a sheet-like shape. Further, since the ferrites 13 are in tight contact with wide surfaces (inner walls of the top face 11*a* and the bottom face 11*b* in this embodiment) of the rectangular waveguide 11, heat generated at the ferrites 13 can be smoothly released through the walls of the rectangular waveguide 11. Thus, a high cooling effect can be achieved. Therefore, the characteristics of the ferrites 13 can be maintained by suppressing a temperature rise at the ferrites 13 even when they are used at a high power, and the ferrite phase shifter 10 can therefore stably achieve high performance.

Figure 3:
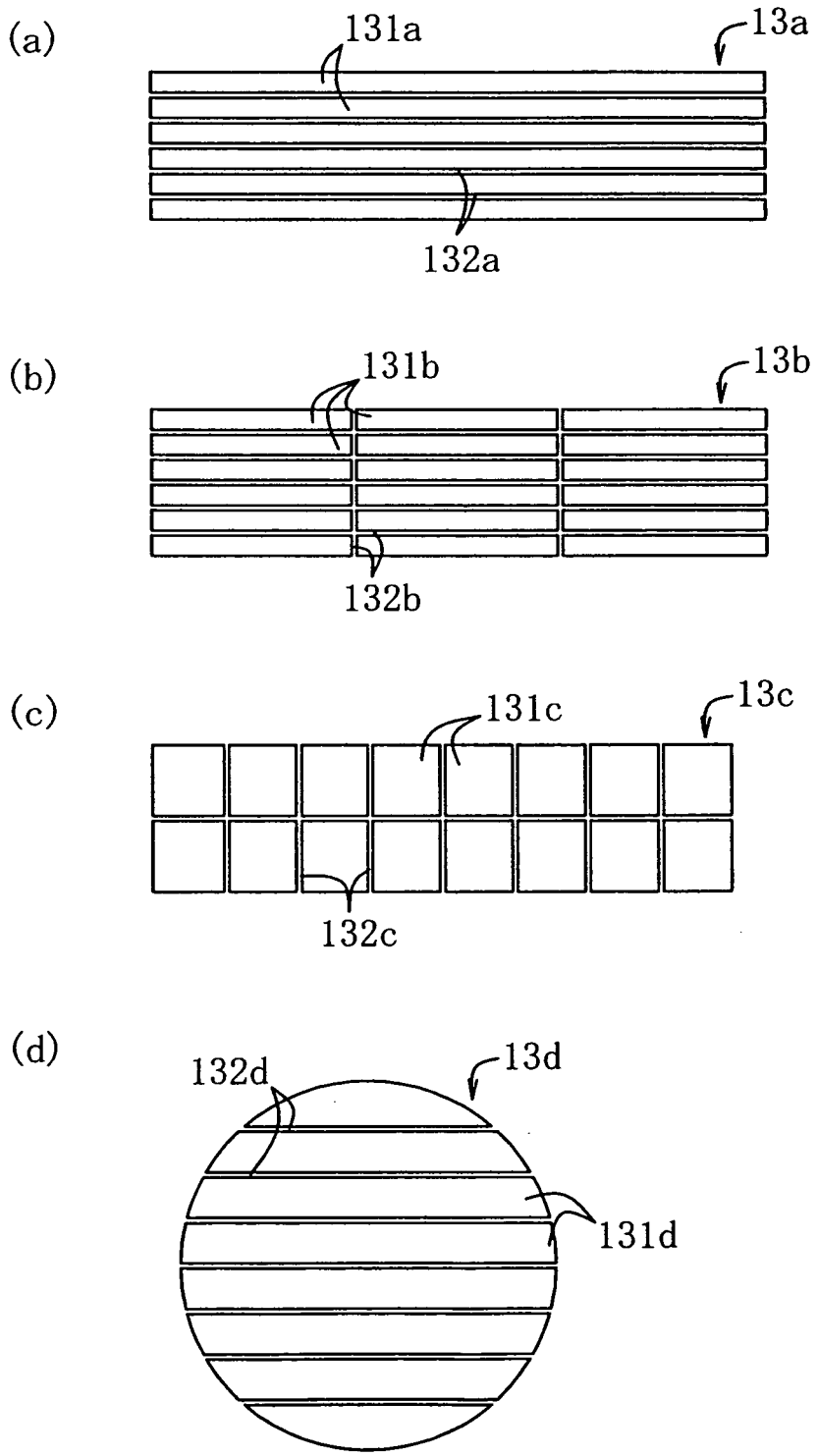
FIGS. 3A to 3D are plan views of modifications of a substantially sheet-like ferrite.

Although substantially sheet-like ferrites of the first embodiment are constituted by the ferrites 13 in the form of monolithic elongate sheets, a substantially sheet-like ferrite according to the invention is not limited to such a configuration. For example, a substantially sheet-like ferrite may be formed by a plurality of ferrite pieces arranged at intervals from each other as shown in FIGS. 3A to 3D. Such alternative configurations may be used also in other embodiments which will be described later. Referring to FIG. 3A, a plurality of ferrite pieces 131*a* in the form of elongate strips are arranged in rows separated from each by small gaps 132*a*, and the pieces collectively form a rectangular and substantially sheet-like ferrite 13*a*. Referring to FIG. 3B, a plurality of strip-like ferrite pieces 131*b* are arranged in rows and columns separated from each other by small gap 132*b*, and the pieces collectively form a rectangular and substantially sheet-like ferrite 13*b*. Referring to FIG. 3C, a plurality of square sheet-like ferrite pieces 131*c* are arranged in rows and columns separated from each other by small gap 132*c*, and the pieces collectively form a rectangular and substantially sheet-like ferrite 13*c*. Referring to FIG. 3D, a plurality of strip-like ferrite pieces 131*d* in the form of sliced parts of a disc extending in a predetermined direction at a predetermined interval from each other are arranged in rows separated from each other by small gaps 132*d*, and the pieces collectively form a circular and substantially sheet-like ferrite 13*d*.

In the above described configurations, the generation of a great thermal stress at the substantially sheet-like ferrites 13*a* to 13*d* is prevented by differences between the expansion coefficients of the rectangular waveguide 11 and the ferrites 13*a* to 13*d*, and cracking of the ferrites can be prevented consequently.

Ferrite Phase Shifter of Second Embodiment

Figure 4:
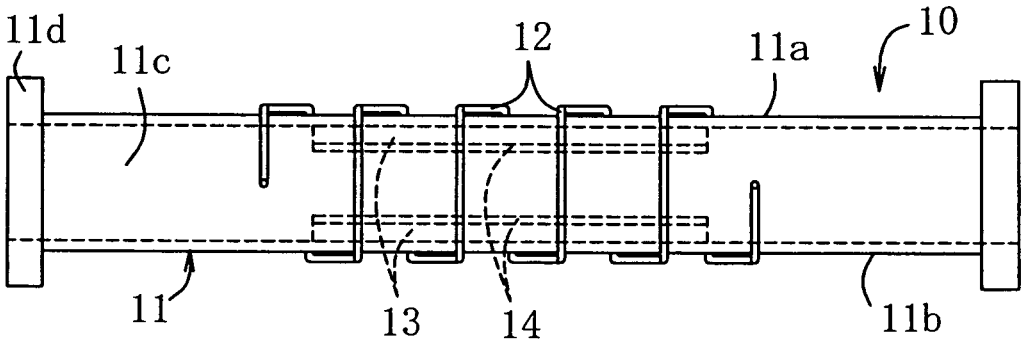
FIG. 4 is a side view of a ferrite phase shifter according to a second embodiment of the invention.

In a ferrite phase shifter 10 according to a second embodiment of the invention, as shown in FIG. 4, a dielectric layer 14 is provided throughout each of wide surfaces on one side of ferrites 13 (wide surfaces opposite to mounting surfaces of the ferrites) or surfaces of the ferrites 13 facing each other, and the dielectric layers 14 are provided to face each other. Although the dielectric layers 14 of the present embodiment are in the form of sheet-like dielectric bodies secured on the ferrites 13, the dielectric layers 14 may be provided in any appropriate mode. For example, the dielectric layers 14 may be coatings provided on the ferrites 13. The material of the dielectric layers 14 may be appropriately selected from a certain range of usable materials, and it is preferable to use a material resulting in small loss of a high frequency wave and having high heat resistance. For example, alumina ceramic is preferred. The configuration of the ferrite phase shifter 10 of the second embodiment is otherwise the same as that of the ferrite phase shifter 10 of the first embodiment.

In addition to advantages similar to those of the first embodiment, the ferrite phase shifter 10 of the second embodiment is advantageous in that the provision of the dielectric layers 14 allows an electromagnetic field distribution generated in a rectangular waveguide 11 to be concentrated in the region of the ferrites 13 to increase the electromagnetic field intensity of a high frequency wave in the region of the ferrites 13. Thus, the rate of a phase change caused by the ferrites 13 can be improved.

Ferrite Phase Shifter of Third Embodiment

Figure 5:
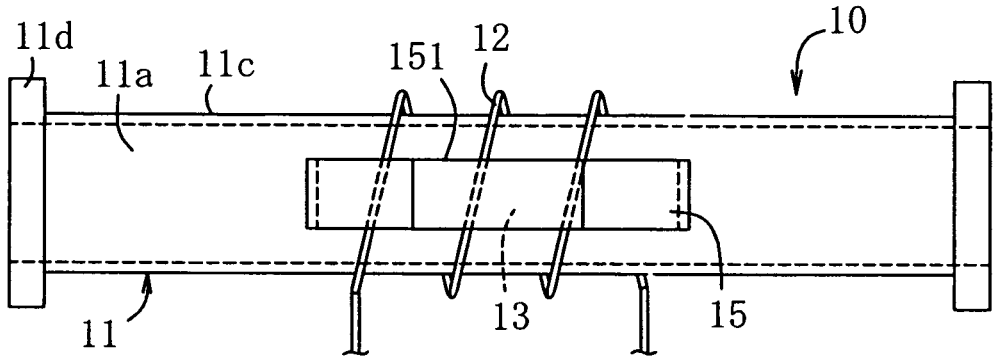
FIG. 5 is a plan view of a ferrite phase shifter according to a third embodiment of the invention.
Figure 6:
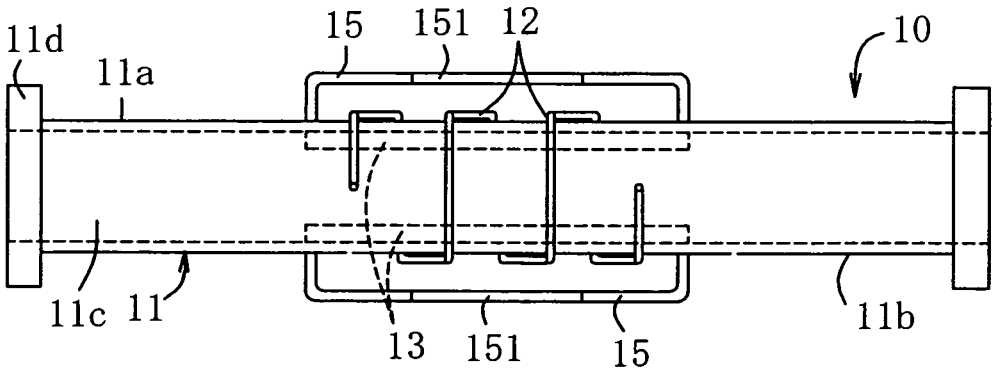
FIG. 6 is a side view of the ferrite phase shifter according to the third embodiment of the invention.

In a ferrite phase shifter 10 according to a third embodiment of the invention, as shown in FIGS. 5 and 6, a coil 12 is wound around a rectangular waveguide 11 in a number of turns smaller than that in the first embodiment. A yoke 15 is provided at each of outer walls of a top face 11 and a bottom face 11*b* which are wide surfaces of the rectangular waveguide 11, the yoke 15 being provided in a position substantially corresponding to the position of an elongate sheet-like ferrite 13.

The yokes 15 are formed like sheets which are C-shaped in a side view thereof, and the yokes are disposed so as to enclose the coil 12 from outside with their C-shaped configuration. Both ends of the yokes are positioned in association with both ends of the respective ferrites 13 in the longitudinal direction thereof which agrees with the longitudinal direction of the rectangular waveguide 11. The ends of the yokes are secured to the outer walls of the top face 11*a* and the bottom face 11*b*. Although the yokes 15 of the present embodiment include a permanent magnet 151 provided substantially in the middle thereof, the parts of the yokes 15 occupied by the permanent magnets 151 may alternatively be made of the same material as other parts of the yokes. While the yokes 15 and the permanent magnets 151 of the present embodiments are formed with substantially the same width as that of the rectangular ferrites 13, the width may be appropriately set as occasion demands. The size and the position of the permanent magnets 151 may be appropriately set as long as they are provided as part of the yokes 15. The materials of the yokes 15 and the permanent magnets 151 may be appropriately selected from certain ranges of usable materials. For example, the yokes 15 are preferably ferrite cores, and the permanent magnets 151 are preferably ferrite type magnets or rare earth type magnets. The configuration of the ferrite phase shifter 10 of the third embodiment is otherwise the same as that of the ferrite phase shifter 10 of the first embodiment.

In addition to advantages similar to those of the first embodiment, the ferrite phase shifter 10 of the third embodiment is advantageous in that the magnetic circuits formed by the ferrites 13 and the yokes 15 allow the amount of a current flowing through the coil 12 to be reduced or allow the number of turns of the coil 12 to be reduced. The permanent magnets 151 provided in part of the yokes 15 allow a magnetic bias to be applied to reduce the amount of a phase change and to improve response.

Ferrite Phase Shifter of Fourth Embodiment

Figure 7:
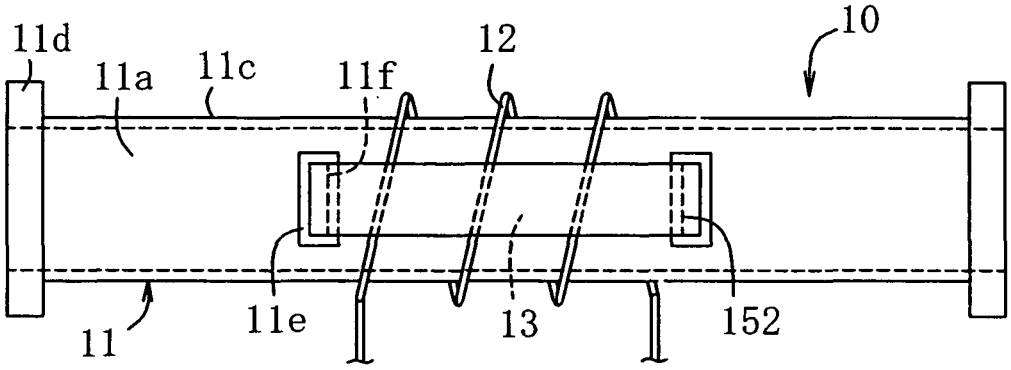
FIG. 7 is a plan view of a ferrite phase shifter according to a fourth embodiment of the invention.
Figure 8:
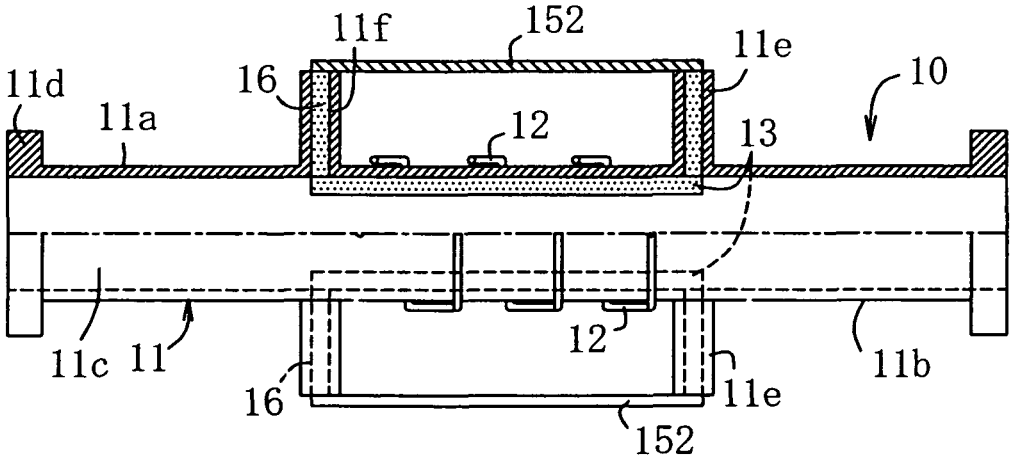
FIG. 8 is a side view, partly in longitudinal section, of the ferrite phase shifter according to the fourth embodiment of the invention.

In a ferrite phase shifter 10 according to a fourth embodiment of the invention, as shown in FIGS. 7 and 8, a rectangular waveguide 11 is formed with square cylindrical sections 11*e* protruding outward in positions corresponding to both ends of ferrites 13 in the longitudinal direction thereof which agrees with the longitudinal direction of the rectangular waveguide 11. Holes 11*f* in the square cylindrical sections 11*e* have a size and a depth which provide a cut-off structure for a high frequency wave propagating in the waveguide. In the present embodiment, a pair of holes 11*f* is formed for one ferrite 13, and two pairs of holes 11*f* are therefore provided for the ferrites 13 on both sides.

In each of the holes 11*f*, a ferrite 16 in the form of a square pole adapted in shape and size to the hole 11*f* is provided. An inner end of the ferrite 16 is connected to an end of the ferrite 13 in the rectangular waveguide 11. An elongate sheet-like yoke 152 is stretched between tips of square cylindrical sections 11*e* protruding in the same direction, and both ends of the yoke 152 are in contact with respective ferrites 16. Outer ends of ferrites 16 protruding in the same direction are connected with each other through a yoke 152.

A coil 12 is wound around the rectangular waveguide 11 with a number of turns smaller than that in the first embodiment, and the coil 12 thus wound is enclosed from outside by C-shaped parts formed by the square cylindrical sections 11*e* and the yokes 152. The materials of the ferrites 16 and the yokes 152 may be appropriately selected from ranges of usable materials. For example, the ferrites 16 are preferably garnet type ferrites, and the yokes 152 are preferably ferrite cores. While the ferrites 16, the yokes 152, and the holes 11*f* are formed with substantially the same width as that of the ferrites 13 in the present embodiment, the width of those elements may be appropriately set as occasion demands. Some part of the yokes 152 such as intermediate parts of the same may be permanent magnets as in the third embodiment. The configuration of the ferrite phase shifter 10 of the fourth embodiment is otherwise the same as that of the ferrite phase shifter 10 of the first embodiment.

In addition to advantages similar to those of the first embodiment, the ferrite phase shifter 10 of the fourth embodiment of the invention is advantageous in that the magnetic circuits formed by the sheet-like ferrites 13, the separately provided square-pole-shaped ferrites 16, and the yokes 152 allow the amount of a current flowing through the coil 12 to be reduced or allow the number of turns of the coil 12 to be reduced. The holes 11*f* serving as a cut-off structure make it possible to prevent undesired radiation of a high frequency wave and the entrance of an electromagnetic wave from outside and to improve response of a variable magnetic field to the rate of a time-varying change in a control current passed through the coil 12. When permanent magnets are provided in some part of the yokes 152, a magnetic bias can be applied to reduce the amount of a phase change and to achieve a further improvement in response.

Ferrite Phase Shifter of Fifth Embodiment

Figure 9:
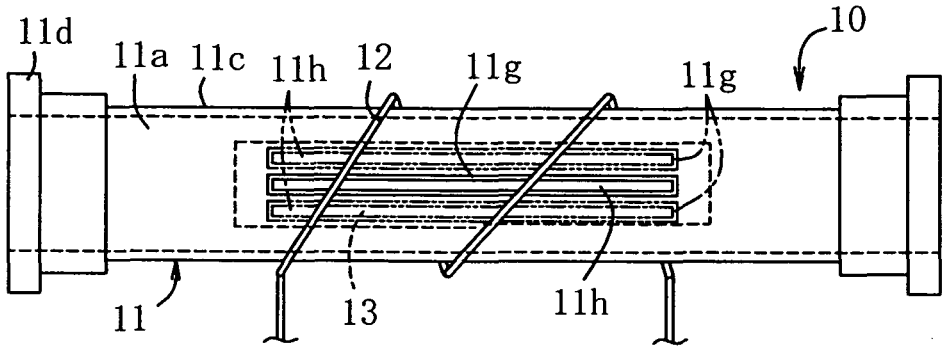
FIG. 9 is a plan view of a ferrite phase shifter according to a fifth embodiment of the invention.
Figure 10:
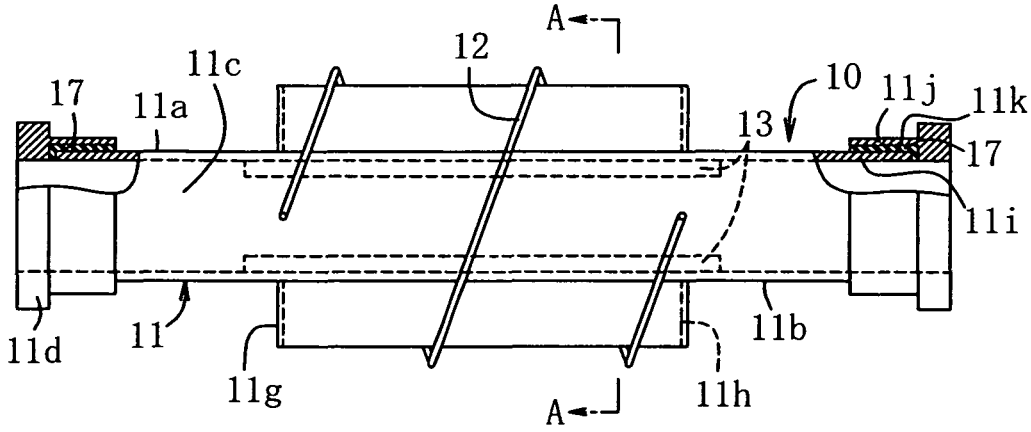
FIG. 10 is a side view, partly in longitudinal section, of the ferrite phase shifter according to the fifth embodiment of the invention.
Figure 11:
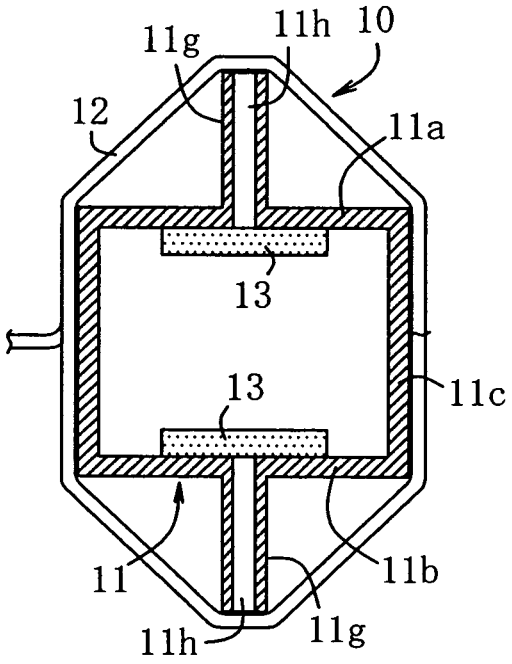
FIG. 11 is a sectional view of the ferrite phase shifter in FIG. 10 taken along the line A-A.

In a ferrite phase shifter 10 according to a fifth embodiment of the invention, as shown in FIGS. 9 to 11, elongate square cylindrical sections 11*g*, whose longitudinal direction agrees with the propagating direction of a high frequency wave (the longitudinal direction of a rectangular waveguide 11), are provided to protrude outward from a top face 11*a* and a bottom face 11*b* which are wide surfaces of the rectangular waveguide 11. Slits 11*h* are provided in the elongate square cylindrical sections 11*g* such that the longitudinal direction of the slits agrees with the longitudinal direction of the rectangular waveguide 11. The elongate square cylindrical sections 11*g* and the slits 11*h* are provided in positions which are substantially corresponding to the positions of ferrites 13 in the rectangular waveguide 11. Although those elements are provided inside the ferrites 13 when viewed from above, the slits 11*h* may be formed longer than the length of the ferrites 13. A coil 12 is wound around outer ends of the elongate square cylindrical sections 11*g*, and the coil is helically wound with a number of turns smaller than that of the coil 12 in the first embodiment.

Two walls, i.e., an inner wall 11*i* and an outer wall 11*j*, are provided inwardly from flanges 11*d* at each longitudinal end of the rectangular waveguide 11, and the outer wall 11*j* is provided outside the inner wall 11*i* at a predetermined interval from the same. A circumferential gap 11*k* having an L-like sectional shape is formed between the inner wall 11*i* and the outer wall 11*j*. The gap 11*k* is exposed on the exterior of the rectangular waveguide 11 in a position corresponding to the position of the tip of the outer wall 11*j* and exposed on the interior of the rectangular waveguide 11 in a position corresponding to the position of the tip of the inner wall 11*i*, and the gap therefore penetrates through the rectangular waveguide 11 between the inside and outside of the same. An insulator 17 having a shape adapted to the shape of the gap 11*k* is provided in the gap 11*k*. The inner walls 11*i*, the insulators 17, and the outer walls 11*j* which are integral with the flanges 11*d* may be secured in an appropriate manner, e.g., securing those elements by fitting them with each other. The configuration of the ferrite phase shifter 10 of the fifth embodiment is otherwise the same as that of the ferrite phase shifter 10 of the first embodiment.

In addition to advantages similar to those of the first embodiment, the ferrite phase shifter 10 of the fifth embodiment of the invention is advantageous in that the provision of the elongate square cylindrical sections 11*g* and the slits 11*h* makes it possible to increase a magnetic resistance to a variable magnetic field and to suppress an eddy current generated by a variable magnetic field on an outer wall of a wide surface. Since the insulators 17 are provided outside both longitudinal ends of the slits 11*h*, the rectangular waveguide 11 forming part of the ferrite phase shifter 10 can be insulated from rectangular waveguides connected upstream and downstream of the same, which allows the effect of suppressing an eddy current to be improved.

The fifth embodiment has a configuration in which one elongate square cylindrical section 11*g* having a slit 11*h* or one slit 11*h* is provided on each of the top face 11*a* and the bottom face 11*b* of the rectangular waveguide 11. For example, elongate square cylindrical sections 11*g* each having a slit 11*h* represented in a two-dot chain line in FIG. 9 may alternatively provided on both sides of an elongate square cylindrical section 11*g* having a slit 11*h* represented in a solid line in FIG. 9. Thus, three each elongate square cylindrical sections 11*g* each having a slit 11*h* or three each slits 11*h* may be provided side by side on each of the top face 11*a* and the bottom face 11*b* of the rectangular waveguide 11. When a plurality of elongate square cylindrical sections 11*g* each having a slit 11*h* or a plurality of slits 11*h* are provided side by side on each of the top face 11*a* and the bottom face 11*b* of the rectangular waveguide 11 as thus described, a magnetic resistance to a variable magnetic field can be more preferably increased, and an eddy current generated by a variable magnetic field on an outer wall of a wide surface can be more preferably suppressed. The configuration in which the elongate square cylindrical sections 11*g* each having a slit 11*h* or the slits 11*h* are provided side by side on each of the top face 11*a* and the bottom face 11*b* may be used in each embodiment including the elongate square cylindrical sections 11*g* having a slit 11*h*.

Ferrite Phase Shifter of Sixth Embodiment

Figure 12:
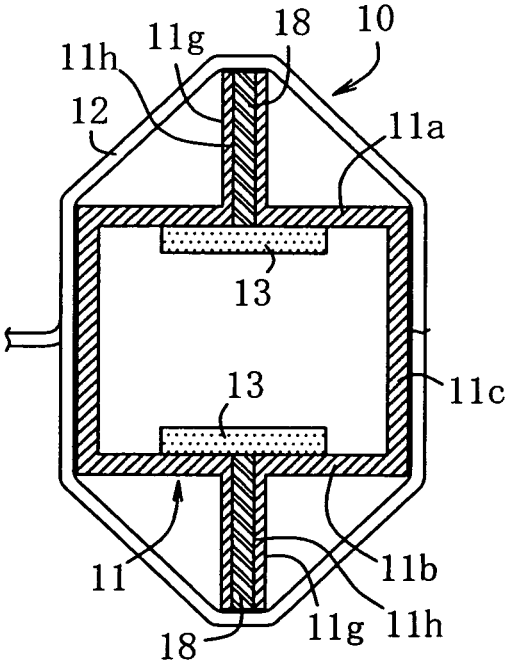
FIG. 12 is a sectional view of a ferrite phase shifter according to a sixth embodiment of the invention.

In a ferrite phase shifter 10 according to a sixth embodiment of the invention, as shown in FIG. 12, dielectric bodies 18 are provided in slits 11*h* of a ferrite phase shifter 10 according to the fifth embodiment. Specifically, sheet-like dielectric bodies 18 having a shape and a size adapted to the slits 11*h* are inserted in the slits 11*h*, and inner ends of the dielectric bodies 18 are in contact with a top surface of ferrites 13. The material of the dielectric bodies 18 may be appropriately selected from a range of usable materials. For example, a Teflon sheet is preferably used ("Teflon" is a registered trademark). The configuration of the ferrite phase shifter 10 of the sixth embodiment is otherwise the same as that of the ferrite phase shifter 10 of the fifth embodiment.

In addition to advantages similar to those of the fifth embodiment, the ferrite phase shifter 10 of the sixth embodiment is advantageous in that a dielectric body 18 provided in a slit 11*h* provides the region of the slit 11*h* with capacitive properties. As a result, impedance to a high frequency wave can be reduced to prevent the leakage of the high frequency wave.

Ferrite Phase Shifter of Seventh Embodiment

Figure 13:
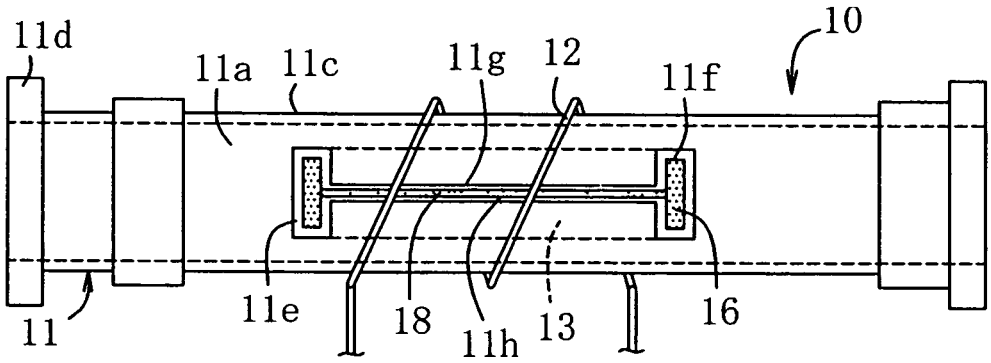
FIG. 13 is a plan view of a ferrite phase shifter according to a seventh embodiment of the invention.
Figure 14:
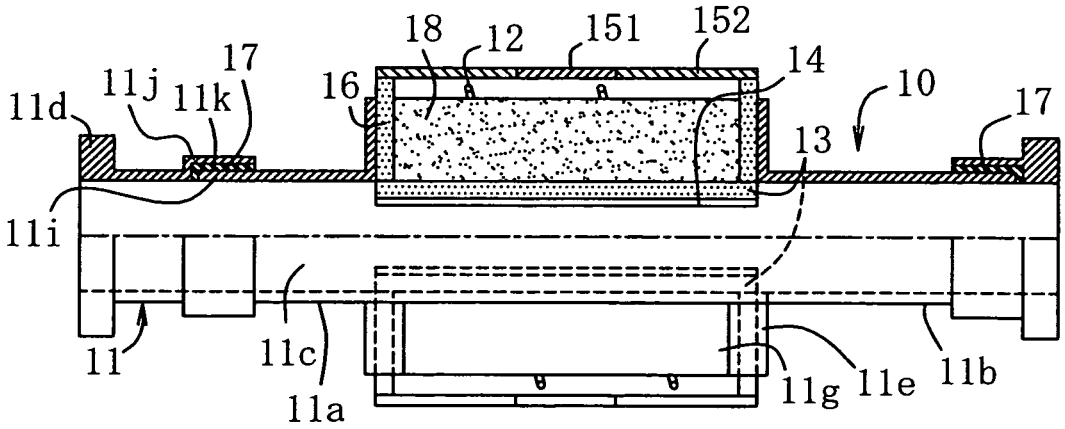
FIG. 14 is a side view, partly in longitudinal section, of the ferrite phase shifter according to the seventh embodiment of the invention.

A ferrite phase shifter 10 according to a seventh embodiment of the invention is basically a combination of the configurations of the second, third, and fourth embodiments and the configuration of the sixth embodiment including the features of the fifth embodiment. Hereinafter, the configurations according to the first to sixth embodiments are used unless otherwise specified. As shown in FIGS. 13 and 14, the ferrite phase shifter 10 according to the seventh embodiment includes a rectangular waveguide 11 formed by a top face 11*a*, a bottom face 11*b*, side faces 11*c*, and flanges 11*d*. Rectangular and elongate sheet-like ferrites 13 are mounted on inner walls of the top face 11*a* and the bottom face 11*b* of the rectangular waveguide 11 so as to face each other. Dielectric layers 14 are provided on surfaces of the ferrites 13 opposite to the mounting surfaces thereof, and the dielectric layers 14 are disposed to face each other.

Square cylindrical sections 11*e* are formed on the top face 11*a* and the bottom face 11*b* of the rectangular waveguide 11 such that they protrude outward at both ends of the ferrites in the longitudinal direction of the waveguide 11. Holes 11*f* in the square cylindrical sections 11*e* are holes whose size and depth serve as a cut-off for a high frequency wave propagating in the waveguide. Each hole 11*f* contains a square-pole-shaped ferrite 16 which is adapted to the shape of the hole 11*f* and which is longer than the depth of the hole 11*f*, and an inner end of the ferrite 16 is connected to an end of the ferrite 13. An outer end of the ferrite 16 slightly outwardly protrudes from the square cylindrical section 11*e*. The outer ends of ferrites 16 protruding in the same direction are connected through a yoke 152 and a permanent magnet 151 provided in part of the yoke 152.

Further, elongate square cylindrical sections 11*g* whose longitudinal direction agrees with the longitudinal direction of the rectangular waveguide 11 are provided to protrude outward from the top face 11*a* and the bottom face 11*b*. The elongate square cylindrical sections 11*g* are formed with a slit 11*h* therein extending in the longitudinal direction of the same. The elongate square cylindrical sections 11*g* of the present embodiment are provided between respective pairs of square cylindrical sections 11*e* and are formed integrally with the square cylindrical sections 11*e*, and the slits 11*h* are in communication with the holes 11*f* in the square cylindrical sections 11*e*. Dielectric bodies 18 are inserted in the slits 11*h*, and inner ends of the dielectric bodies 18 are in contact with a top surface of the ferrites 13, and both ends of the dielectric bodies 18 on the longitudinal direction of the rectangular waveguide 11 are in contact with the ferrites 16 in the holes 11*f*.

A coil 12 is wound around the exterior of the elongate square cylindrical sections 11*g* and the dielectric bodies 18 such that the coil is inserted between the elongate square cylindrical sections 11*g* containing the dielectric bodies 18 and the yoke 152, and the coil is helically wound in a number of turns smaller that of the coil 12 of the first embodiment.

Insulators 17 are provided outside both longitudinal ends of the slits 11*h*. One insulator 17 having the same configuration as that in the fifth embodiment is provided near one longitudinal end (right end in FIG. 14) of the rectangular waveguide 11 inside and adjacent to the flange 11*d*. Another insulator 17 having the same configuration as that in the fifth embodiment is provided near the other longitudinal end (left end in FIG. 14) of the rectangular waveguide 11 inside the flange 11*d* and at a predetermined distance from the flange 11*d*. Specifically, two walls, i.e., an inner wall 11*i* and an outer wall 11*j*, are provided in a predetermined position at the other end of the waveguide, and the outer wall 11*j* is disposed outside the inner wall 11*i* with a predetermined gap provided between them. A circumferential gap 11*k* having an L-like sectional shape is defined between the inner wall 11*i* and the outer wall 11*j*. The gap 11*k* is exposed on the exterior of the rectangular waveguide 11 in a position corresponding to an end of the outer wall 11*j*, and the gap opens into the space inside the rectangular waveguide 11 in a position corresponding to an end of the inner wall 11*i*. Thus, the gap penetrates through the rectangular waveguide 11 between the exterior and interior of the same. The insulator 17 having a shape adapted to the shape of the gap 11*k* is provided in the gap 11*k*.

The ferrite phase shifter 10 of the seventh embodiment has the same advantages as those of the ferrite phase shifters 10 of the first to sixth embodiments.

Example of Automatic Matching Apparatus Having Ferrite Phase Shifter According to the Embodiments An example of an automatic matching apparatus having a ferrite phase shifter 10 according to an embodiment of the invention as described above. The ferrite phase shifter 10 of the automatic matching apparatus of the example may be any of the ferrite phase shifters 10 according to first to seventh embodiments.

Figure 15:
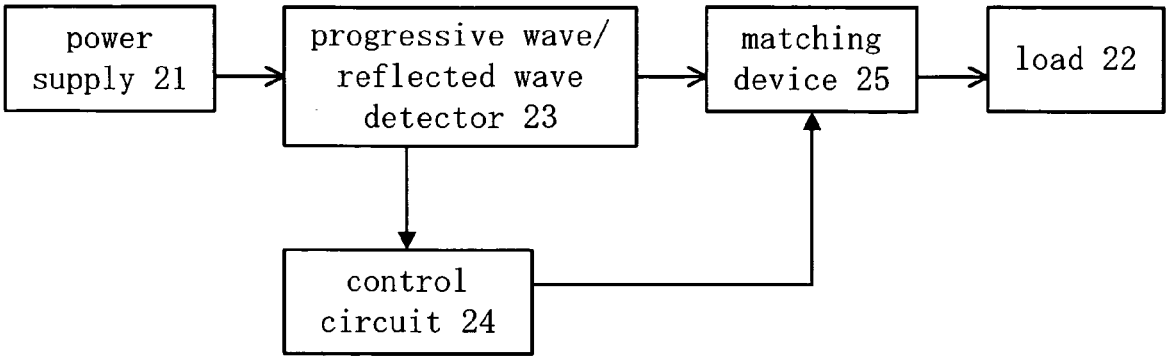
FIG. 15 shows a configuration of an example of an automatic matching apparatus.

As shown in FIG. 15, in the automatic matching apparatus of the example, a progressive wave/reflected wave detector 23 and a matching device 25 employing a ferrite phase shifter 10 as a matching element are provided in the order listed in a waveguide path (transmission path) formed by a rectangular waveguide 11 and rectangular waveguides 32 to be described later provided between a power supply 21 and a load 22. A result of detection at the progressive wave/reflected wave detector 23 is input to a control circuit 24, and the control circuit 24 varies the amount of a control current passed through the matching device 25 according to the detection result. The phase of the ferrite phase shifter 10 is changed according to the change in the control current to match the power supply 21 and the load 22 automatically. The progressive wave/reflected wave detector 23 is disposed at a power input side of the automatic matching apparatus. The detector performs calculations to obtain signals representing the absolute value $|\Gamma|$ of a reflection coefficient and a phase angle $\theta$ from signals representing a progressive wave and a reflected wave and inputs the signals to the control circuit 24. The control circuit 24 operates according to a control program set and stored in advance to change the value of the control current corresponding to the input calculation results with reference to a correspondence table such as a Smith chart which is set and stored in advance.

Examples of the matching device 25 employing a ferrite phase shifter 10 as a matching element will now be described.

Figure 16:
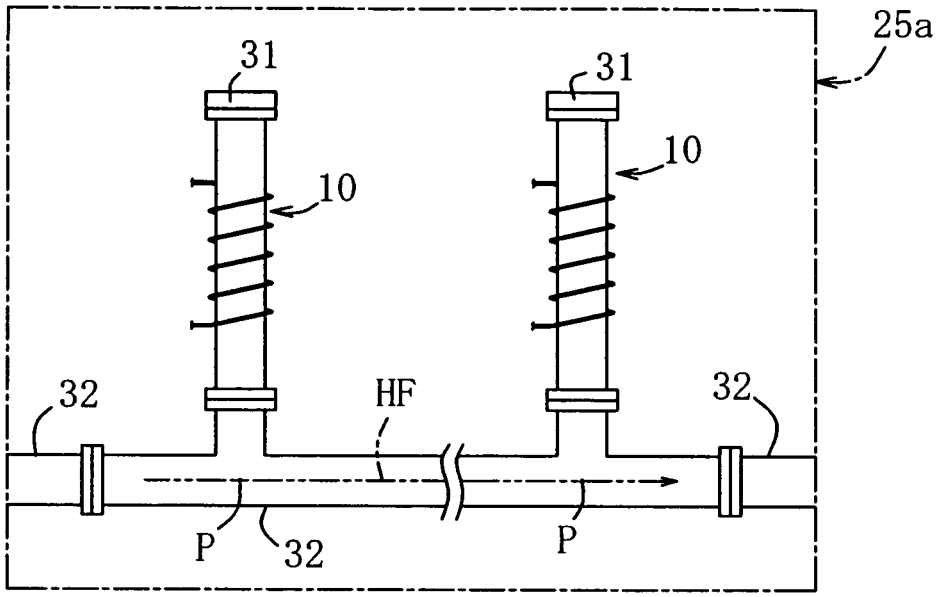
FIG. 16 is an illustration of a first example of an automatic matching apparatus having a matching device employing a ferrite phase shifter.

As shown in FIG. 16, in a matching device 25*a* of a first example, a waveguide path is formed by connecting rectangular waveguides 32, and a high frequency signal HF is passed through the waveguide path from a power supply 21 toward a load 22. One end of each of a plurality of ferrite phase shifters 10 is coupled with a lateral part of a rectangular waveguide 32 forming part of the waveguide path, and a shorting plate 31 is provided at another end of each ferrite phase shifter 10. The matching device 25*a* of the first example changes the state of impedance matching by causing a phase change at points P which are associated with the other ends of the ferrite phase shifters 10.

Figure 17:
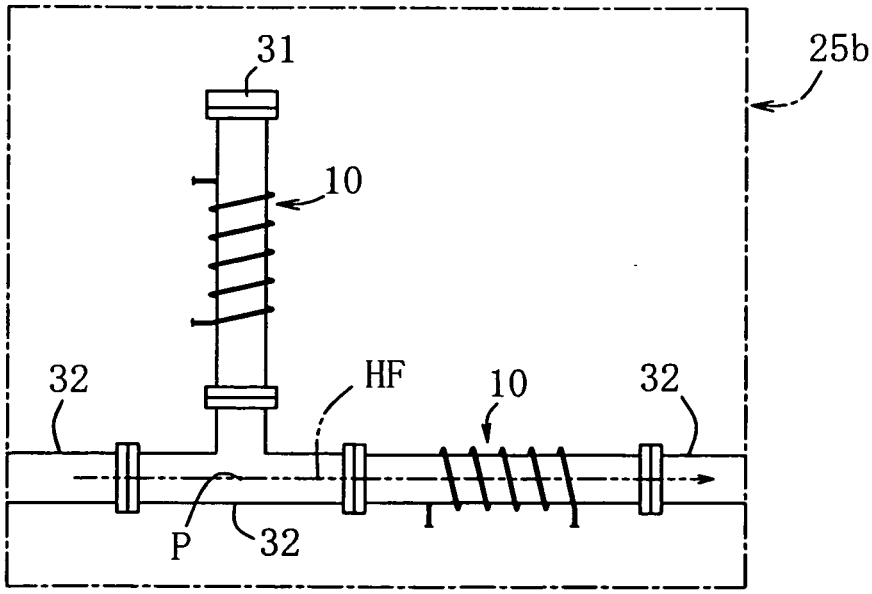
FIG. 17 is an illustration of a second example of an automatic matching apparatus having a matching device employing a ferrite phase shifter.

In a matching device 25*b* of a second example, a waveguide path is formed by connecting rectangular waveguides 32 and a ferrite phase shifter 10 as shown in FIG. 17, and a high frequency signal HF is passed through the waveguide path from a power supply 21 toward a load 22. One end of another ferrite phase shifter 10 is coupled with a lateral part of the rectangular waveguide 32 connected upstream of the ferrite phase shifter 10 forming part of the waveguide path, and a shorting plate 31 is provided at another end of the ferrite phase shifter 10. The matching device 25*b* of the second example changes the state of impedance matching by causing a phase change at a point P associated with the other end of the ferrite phase shifter 10 coupled with the lateral part and the ferrite phase shifter 10 forming part of the waveguide path.

In the example shown in FIG. 17, the position of the ferrite phase shifter 10 connected to the lateral part of the rectangular waveguide 32 forming part of the waveguide path is located closer to the power supply than the ferrite phase shifter 10 forming part of the waveguide path. Alternatively, the ferrite phase shifter 10 may be positioned closer to the load than the ferrite phase shifter 10 forming part of the waveguide path.

The above-described automatic matching apparatus can be electrically (electronically) driven, whereas automatic matching apparatus according to the related art are mechanically driven. Therefore, a higher matching speed can be achieved to shorten matching time. Specifically, a matching time in the range from 10 to 20 msec can be achieved, whereas matching has taken 1 to 2 sec according to the related art. Further, since the apparatus scarcely fails, it can be used on a maintenance free basis.

A ferrite phase shifter according to the invention like the ferrite phase shifters 10 of the first to seventh embodiments may be provided as a matching element of a matching device in an appropriate automatic matching apparatus other than the first and second examples. Such a ferrite phase shifter may be provided in various devices or circuits within a certain range of applicability other than matching devices of automatic matching apparatus.

For example, the invention can be applied to phase shifters for changing the phase of an electromagnetic wave propagating in a waveguide.

What is claimed is:

1. An electronically driven automatic matching apparatus comprising:

a matching device employing a plurality of ferrite phase shifters as a matching element, with a first end of each of said plurality of ferrite phase shifters being coupled with a lateral part of a first rectangular wave guide and a shortening plate being provided at a second end of each of said plurality of ferrite phase shifters, between a power supply and a load:

each of said plurality of ferrite phase shifters comprising:

a second rectangular waveguide;

substantially sheet-like ferrites disposed to face each other with respective mounting surfaces thereof kept in tight contact with inner walls of wide surfaces of the second rectangular waveguide and dielectric layers provided on surfaces of the substantially sheet-like ferrites facing each other; and a coil wound around a periphery of the second rectangular waveguide in a position substantially corresponding to a position of the substantially sheet-like ferrites and through which a control current is passed, whereby electronic change of the control current changes a phase of the respective phase shifter to automatically match the power supply and the load.

2. An electronically driven automatic matching apparatus according to claim 1, comprising at least one pair of holes having a structure to serve as a cut-off for a propagating high frequency wave, the holes being provided at both ends of the substantially sheet-like ferrites in a longitudinal direction of the second rectangular waveguide; and additional ferrites different from the substantially sheet-like ferrites provided in each of the holes, wherein inner ends of the additional ferrites are connected to the substantially sheet-like ferrites; and outer ends of the additional ferrites are connected to each other through yokes.

3. An electronically driven automatic matching apparatus according to claim 2, comprising a permanent magnet provided in part of the yokes.

4. An electronically driven automatic matching apparatus according to claim 3, comprising at least one elongate square cylindrical section provided on each of the wide surfaces of the second rectangular waveguide so as to protrude outwardly, the at least one elongate cylindrical section having a slit whose longitudinal direction agrees with a longitudinal direction of the second rectangular waveguide.

5. An electronically driven automatic matching apparatus according to claim 2, comprising at least one elongate square cylindrical section provided on each of the wide surfaces of the second rectangular waveguide so as to protrude outwardly, the at least one elongate cylindrical section having a slit whose longitudinal direction agrees with a longitudinal direction of the second rectangular waveguide.

6. An electronically driven automatic matching apparatus comprising:

a matching device employing a plurality of ferrite phase shifters as a matching element, with a first end of each of said plurality of ferrite phase shifters being coupled with a lateral part of a first rectangular wave guide and a shortening plate being provided at a second end of each of said plurality of ferrite phase shifters, between a power supply and a load:

each of said plurality of ferrite phase shifters comprising:

a second rectangular waveguide;

substantially sheet-like ferrites disposed to face each other with respective mounting surfaces thereof kept in tight contact with inner walls of wide surfaces of the second rectangular waveguide;

dielectric layers on surfaces of the substantially sheet-like ferrites facing each other;

a coil wound around a periphery of the second rectangular waveguide in a position substantially corresponding to a position of the substantially sheet-like ferrites and through which a control current is passed, whereby electronic change of the control current changes a phase of the respective phase shifter to automatically match the power supply and the load; and yokes provided in positions substantially corresponding to the position of the substantially sheet-like ferrites on outer walls of the wide surfaces of the second rectangular waveguide.

7. An electronically driven automatic matching apparatus according to claim 6, comprising a permanent magnet provided in part of the yokes.

8. An electronically driven automatic matching apparatus according to claim 7, comprising at least one elongate square cylindrical section provided on each of the wide surfaces of the second rectangular waveguide so as to protrude outwardly, the at least one elongate cylindrical section having a slit whose longitudinal direction agrees with a longitudinal direction of the second rectangular waveguide.

* * * * *